US009347747B2

(12) United States Patent
Mickiewicz

(10) Patent No.: US 9,347,747 B2
(45) Date of Patent: May 24, 2016

(54) VARIABLE BALLISTIC SHIELD SYSTEM

(71) Applicant: Dean Chester Mickiewicz, Deerfield Beach, FL (US)

(72) Inventor: Dean Chester Mickiewicz, Deerfield Beach, FL (US)

( * ) Notice: Subject to any disclaimer, the term of this patent is extended or adjusted under 35 U.S.C. 154(b) by 0 days.

(21) Appl. No.: 13/774,189

(22) Filed: Feb. 22, 2013

(65) Prior Publication Data

US 2014/0238225 A1 Aug. 28, 2014

(51) Int. Cl.
*F41H 5/08* (2006.01)
*F41H 5/26* (2006.01)

(52) U.S. Cl.
CPC ... *F41H 5/08* (2013.01); *F41H 5/26* (2013.01)

(58) Field of Classification Search
CPC ..... F41H 5/08; F41H 5/013; F41H 5/24
USPC ..... 89/36.02, 36.05, 36.07, 36.09, 926
See application file for complete search history.

(56) References Cited

U.S. PATENT DOCUMENTS

| | | | | |
|---|---|---|---|---|
| 1,277,706 | A * | 9/1918 | Dorfman | 160/130 |
| 2,921,317 | A * | 1/1960 | Tifft | 2/2.5 |
| 5,392,686 | A * | 2/1995 | Sankar | 89/36.05 |
| 6,000,347 | A * | 12/1999 | Madden, Jr. | 109/49.5 |
| 7,302,880 | B1 * | 12/2007 | Elasic | 89/36.07 |
| 7,891,283 | B2 * | 2/2011 | Kleniatis et al. | 89/36.09 |
| 8,015,910 | B1 * | 9/2011 | Fuqua et al. | 89/36.09 |
| 2011/0011255 | A1 * | 1/2011 | Kleniatis et al. | 89/36.09 |

* cited by examiner

*Primary Examiner* — Bret Hayes
*Assistant Examiner* — Joshua Freeman

(57) ABSTRACT

A ballistic shield may include multiple ballistic plates. The first plate may be permanently connected to a second plate and drop vertically downward from the first plate. After dropping down, the second plate would overlap the first plate such that no gap exists between the two plates. A third plate may similarly drop with respect to the second plate. Side folding ballistic plates may be attached to the first and second plates to lock them in position and provide ballistic protection to the sides of the user. These side ballistic plates may overlap the first and second plates. The side plates can have another ballistic plate mounted on their unconnected ends such that another assembly of first, second and side ballistic plates identical as above may also be connected. After connecting this second assembly, the user(s) would have full 360 degree ballistic coverage.

2 Claims, 3 Drawing Sheets

VARIABLE BALLISTIC SHIELD SYSTEM

RELATED APPLICATIONS

Provisional application No. 61/634,150, filed on Feb. 24, 2012.

BACKGROUND OF THE INVENTION

1. Field of the Invention

The present invention is for man portable (hand held ballistic shields), but may be used for non man portable shields.

2. Description of Related Art

Ballistic shields are used anywhere that a ballistic threat is possible. The main users are security, law enforcement and military. Typically ballistic shields are not meant to replace personal body armor (such as vests), but to add additional protection over areas not protected by a vest and to provide additional protection over areas already protected by the user's body armor.

Ballistic shields (ballistic plates designed to stop or significantly reduce the trauma from high velocity projectiles—such as bullets) are typically one piece. Shields for coverage over the head and chest areas are usually larger and heavy enough such that they are not carried for routine use and thus not available when the threat occurs.

Full body (Head and chest front, pubic region front, possibly some side) coverage with existing ballistic shields usually are large once piece shields. Shields of this type must be stored in larger containment areas, such as the trunk of a police car. Ballistic shields do not exist that offer protection to the head, neck and central (middle) sections of the chest and can also have other ballistic panels (such as folding side and groin panels) attached later for full body (if needed) coverage.

In many emergency situations, a ballistic shield must be deployed in full operational condition by using only one hand, while the user's other hand reaches for their gun. Some ballistic shield devices employ structural members which must be assembled to give them rigidity prior to use. Assembling a shield consumes precious time when a threat exists to the user. Ballistic shields do not have the ability to rigidly connect together for ballistic coverage of different geometries including full 360 degree coverage.

Therefore, a ballistic shield system is needed that can be rapidly deployed with one hand and does not require assembly prior to use, can be upgraded as money becomes available to permit full body coverage and can be connected together with other shields for rigid ballistic coverage of different geometries including 360 degree coverage.

SUMMARY OF THE INVENTION

In accordance with this invention, there are at least 2 parallel ballistic plates rigidly attached to each other by a rail system, such that the two plates will remain parallel to each other and at the same horizontal distance from each other at all times. These first two parallel ballistic plates comprise the core of the embodiment.

The first of these two ballistic plates may have a handle and a mechanism to release the second plate from the stationary first plate. This detachment is deployed by only one hand, while holding the handle. Upon release, gravity moves the second plate downward (vertically) from the first plate. Upon full travel of the second plate, an overlap may exist between the first and second plates to ensure that a gap does not exist. Upon release of the second plate, the core of this ballistic shield assembly is rigid with respect to horizontal forces such as from bullets. The first ballistic plate may have a transparent ballistic section.

Further in accordance with this invention, the first and second ballistic plates may have mechanisms for the attachment of other ballistic plates. Side folding plates may be attached between the extended first and second ballistic plates such that no gap exists between the side plates and the first two plates.

A further implementation with this invention, are folding side ballistic plates that attach to the first two ballistic plates ("core" ballistic shield). The side ballistic plates may fold and are composed of at least 2 rigid ballistic plates (panels). Each side ballistic plate may have a hinge and a rotation mechanism mounted on the first plate. This rotation mechanism may have a rod or similar structural member connecting the rotation mechanism with the distal end of the second of the side ballistic plates. The rotation mechanisms may be rotated and locked in various orientations. Because the structural member prevents the rotation of the next connecting panel, this next connecting panel (ballistic plate) is locked into position. The side ballistic plates may be composed of more ballistic panels which are connected by hinges and the same rotation mechanisms and structural members.

Another implementation coherent with the principles of this invention, is that a ballistic shield may be attached to another similar ballistic shield. Each of the side folding ballistic plates (panels) may be connected to each other and to another "core" of vertically moving ballistic plates. Many different configurations for ballistic coverage are made possible by connecting ballistic plates by using this manner.

Still another implementation coherent with the principles of this invention, is that an intermediate ballistic plate, without a hinge, may be connected between two folding ballistic plates. The intermediate ballistic plates may then be disconnected from the side folding ballistic plates and be used as a man portable ballistic shield.

One other implementation coherent with the principles of the invention, a ballistic shield system may include small ballistic plates attached to the outside to cover the hinges. The ballistic materials (plates) that are parallel with the hinge and provide ballistic coverage over the gap between ballistic materials, which the hinge connects together.

BRIEF DESCRIPTION OF THE DRAWINGS

Similar reference numbers and designations in the various drawings indicate similar elements.

DETAILED DESCRIPTION

The invention described with reference to accompanying drawings, has at least one illustrative representation shown. This invention may be illustrated in different morphologies and should not be construed as limited to the representations contained in this document. The illustrations herewith are not limiting as to the scope of the invention.

Terms may be used interchangeably, unless made expressively clear from the text. The terms "ballistic panel", "panel", "plate" or "ballistic plate" shall be used interchangeably unless specifically made distinguishable from the text.

Similarly, the terms "core", "core assembly" and "basic" shall be interchangeable. Some terms such as "connector" or "fastener" shall be deemed understandable by someone with proficient skills in this art. Some drawings views may have some items missing from an actual ballistic shield. Not having all items in every drawing view is done for clarity and understanding of the entities on that drawing.

Figure 1:
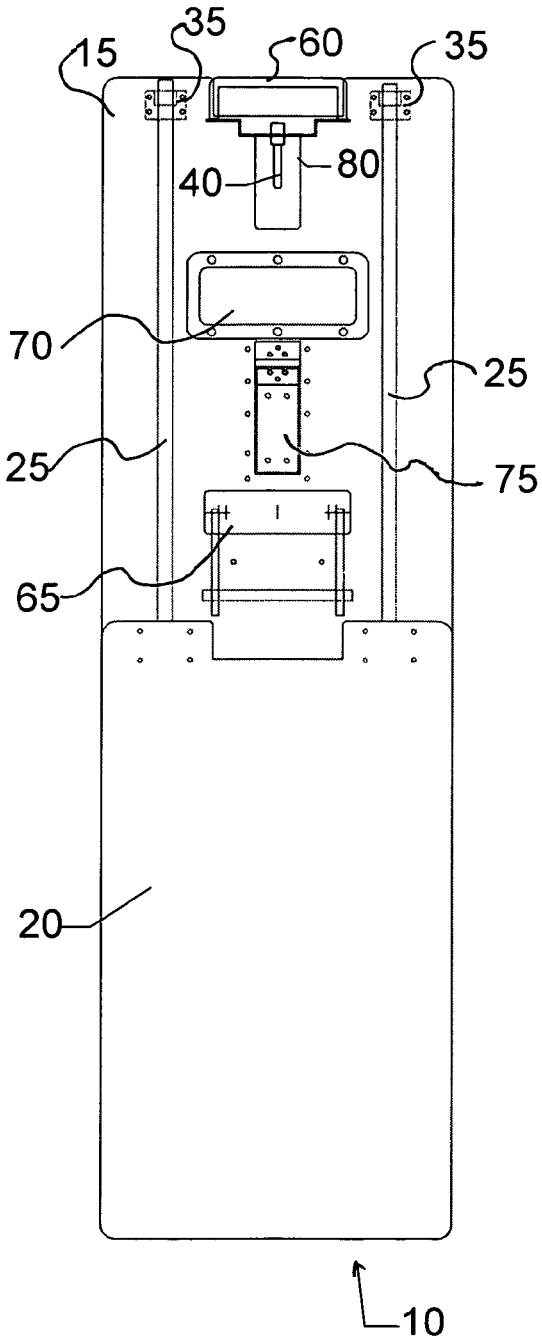
FIG. 1 is the protected side view of the basic two panel opening ballistic shield shown in its expanded condition.
Figure 2:
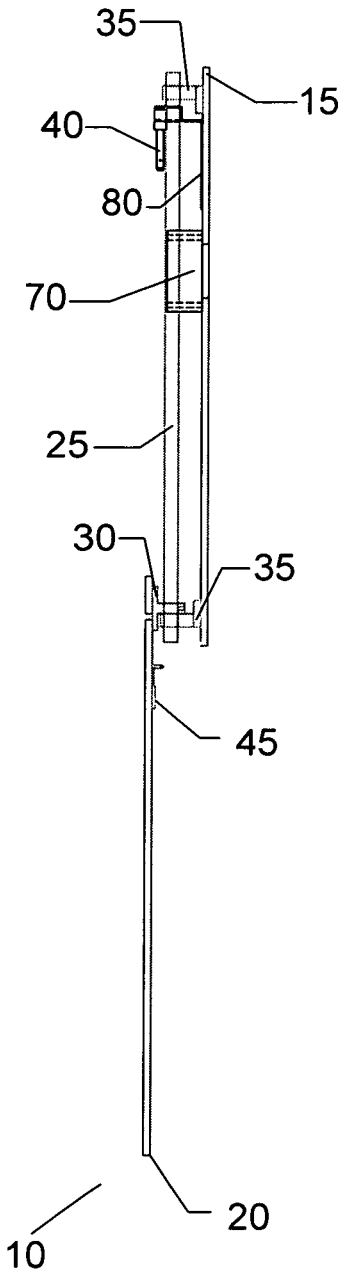
FIG. 2 is the side view of a basic two panel opening ballistic shield shown in its expanded condition.

As shown in FIG. 1, a basic ballistic shield assembly 10 comprised of two ballistic plates 15 on the top and 20 on the bottom. Each ballistic plate in these embodiments shall be made of material sufficient for the threat level designed to encounter. Also because this is primarily designed to be man portable (carried by hand or on rollers), weight of the ballistic materials is a prime consideration. For National Institute of Justice (NIJ) level 3A and NIJ 3, a polymer based material made of aramid, para-aramid or polypropylene is recommended. However for larger shields which may be supported by many men, steel laminate plates with high hardness are recommended. Ballistic plate 15 has four rail mounts 35, two on the top and two on the bottom (FIG. 2) which hold two rails 25 between them. Ballistic plate 20 has two linear bearings 30 which the rails 25 slide through. The rails should be made of a highly polished steel and corrosion resistance for low friction and long service life. The linear bearings 30 are situated between the rail mounts 35. FIG. 1 has a handle 60 at the top of the drawing for carrying the ballistic shield. Item 40 is a release pin. The release pin 40 is suspended parallel from plate 15 by a cantilevered pin bracket connector 80. For prolonged carrying, an internal handle 65 is provided.

Figure 3:
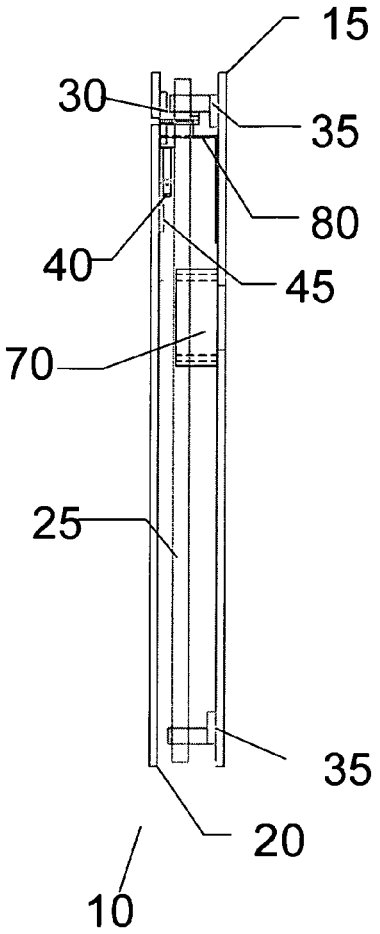
FIG. 3 is the side view of a basic two panel opening ballistic shield shown in its collapsed condition.

FIG. 3 shows the collapsed position of the basic ballistic shield assembly prior to deployment (opening). The release pin 40 is inserted into the release pin bracket 45. The user can hold handle 60 with one hand and press (or pull) the release pin 40 with fingers on the same hand. Upon activation of the release pin, gravity or other means of providing force moves plate 20.

The scope of the invention is defined by the following claims and their physical equivalents.

What is claimed:

1. A ballistic shield comprising of:

A first ballistic plate incorporating ballistic material with at least one rail mounted on the first ballistic plate such that the at least one rail is parallel to the first ballistic plate long axis, a second ballistic plate incorporating ballistic material with linear bearings configured to travel over the at least one rail of the first ballistic plate such that the first and second ballistics remain parallel, a release mechanism configured to disconnect the first ballistic plate from the second ballistic plate to allow movement of the second ballistic plate and wherein said second ballistic plate is configured to partially overlap the first ballistic plate after the two ballistic plates have been separated by the release mechanism.

2. The ballistic shield of claim 1 wherein the first and second ballistic plates remain rigid with respect to horizontal forces without the need for additional stiffening structures.

* * * * *